US007320291B2

(12) United States Patent
Eckert

(10) Patent No.: US 7,320,291 B2
(45) Date of Patent: Jan. 22, 2008

(54) MULTI-PURPOSE, PLASTIC MOLDED, SIT-ON-TOP KAYAK

(76) Inventor: Thomas Eckert, 7159 Taggart Pl., Rancho Cucamonga, CA (US) 91730

( * ) Notice: Subject to any disclaimer, the term of this patent is extended or adjusted under 35 U.S.C. 154(b) by 0 days.

(21) Appl. No.: 11/432,701

(22) Filed: May 11, 2006

(65) Prior Publication Data

US 2006/0254495 A1 Nov. 16, 2006

Related U.S. Application Data

(60) Provisional application No. 60/680,458, filed on May 11, 2005.

(51) Int. Cl.
*B63B 35/00* (2006.01)

(52) U.S. Cl. ..... 114/347

(58) Field of Classification Search ..... 114/347
See application file for complete search history.

(56) References Cited

U.S. PATENT DOCUMENTS

| | | | | |
|---|---|---|---|---|
| 4,660,490 | A | 4/1987 | Broadhurst | 114/56 |
| 5,042,416 | A | 8/1991 | Arcouette | 114/347 |
| 5,061,215 | A | 10/1991 | Walls | 441/45 |
| 5,377,607 | A | 1/1995 | Ross | 114/39.2 |
| 5,397,525 | A | 3/1995 | Niemier | 264/154 |
| 5,425,325 | A | 6/1995 | Washio | 114/290 |
| 5,460,551 | A * | 10/1995 | Beres | 440/27 |
| D364,139 | S | 11/1995 | Niemier | D12/302 |
| 5,493,982 | A | 2/1996 | Carpenter | 114/347 |
| D400,843 | S | 11/1998 | Niemier | D12/302 |
| 5,964,177 | A | 10/1999 | Niemier | 114/347 |
| 6,035,801 | A | 3/2000 | Addison | 114/347 |
| 6,112,692 | A | 9/2000 | Lekhtmann | 114/347 |
| 6,178,912 | B1 | 1/2001 | Niemier | 114/347 |
| 6,210,242 | B1 | 4/2001 | Howard et al. | 440/21 |
| 6,390,013 | B1 * | 5/2002 | Cornell | 114/347 |
| 6,736,084 | B2 * | 5/2004 | McDonough et al. | 114/363 |
| 6,745,716 | B2 | 6/2004 | Belyeu | 114/347 |
| 6,755,145 | B2 | 6/2004 | Bolebruch | 114/347 |
| 6,874,442 | B1 | 4/2005 | McDonough | 114/347 |
| 6,880,481 | B2 * | 4/2005 | Dunn et al. | 114/347 |
| 7,021,234 | B1 * | 4/2006 | Belyeu | 114/347 |
| 2003/0164391 | A1 * | 9/2003 | Zwagerman | 224/576 |

OTHER PUBLICATIONS

Thomas Eckert; Entiled: "Open-Top Kayak"; Filed By: EMSCO, Inc. Disputed Assignment.
Colored Print:.

* cited by examiner

*Primary Examiner*—Stephen Avila
(74) *Attorney, Agent, or Firm*—Willie Krawitz

(57) ABSTRACT

A plastic molded, sit-on-top kayak of unique size and shape is disclosed with various components which provide multi-purpose usage. The kayak is especially useful for multi-purposes such as sailing kayak surfing, scuba diving, paddling, touring and electric motorized usage. The kayak has attachment points integrally molded that provide for these multi-purposes. An important component of the invention includes a removable backrest that additionally provides secure waterproof storage of the operator's personal items. The backrest can be easily removed and reattached securely in place when desired. The ability to easily remove a backrest or backpack option also enables a desirable compact capability for transportation and storage by a user. Additional benefits of this feature provide for a smaller profile for packaging and commercial transportation. The kayak as disclosed may be formed for the most part, typically by blow molding, rotational molding, injection molding, rim molding, fiberglass and thermoforming, and by using a wide variety of polymer materials that may be suitable.

10 Claims, 5 Drawing Sheets

MULTI-PURPOSE, PLASTIC MOLDED, SIT-ON-TOP KAYAK

This application claims the benefit and priority under 35 U.S.C. 119(e) of U.S. Provisional Application No. 60/680,458 filed May 11, 2005 as incoporated herein by reference.

BACKGROUND OF THE INVENTION

This invention relates to a new and improved sit-on-top kayak which provides a multi-purpose usage at relatively low cost using conventional materials and construction techniques.

A sit-on-top kayak makes for a safer product compared to an enclosed kayak which may expose the user to dangerous conditions, particularly if the kayak is suddenly overturned and the user becomes trapped underwater.

Various publications which disclose sit-on-top kayaks include: U.S. Pat. Nos. 4,660,490; 5,042,416; 5,061,215; 5,377,607; 5,397,525; 5,425,325; 5,493,982; 5,964,177; 6,035,801; 6,112,692; 6,178,912; 6,210,242; US 2002/0109251 A1; US 2002/0166493 A1; U.S. Pat. Nos. 6,745,716; 6,755,145; 6,874,442; and, Design Patents D364,139; and, D400,843.

However, the subject matter of the above patents provide little in the way of construction beyond an open shell, and only provide simply paddling by a user rather then providing multi-use purposes.

Hence, an object of this invention provides a multi-purpose, sit-on-top kayak enabling a user to enjoy various aquatic sports while still providing the basic elements of kayaking, such as simply paddling. These multi-purpose uses include such activities as scuba diving; sailing; kayak surfing; motorized use; fishing; touring; a removable back rest for ease of usage; a combination of back rest and storage container unit for food, equipment, etc.; the area under the back pack unit having the capability of functioning as an insulated cooler; and, the back pack having the capability to divide the weight of the storage container and the weight of the kayak for portability purposes.

THE INVENTION

According to the invention, a plastic molded, sit-on-top kayak is provided having multi-purpose usage, the kayak including removable components which are readily installed and removable, and enable a user to engage in various activities without compromising safety, while still providing the basic activity of paddling. Basically, various versions of the kayak may be derived from a single modular configuration which incorporates attachment points for connection with different components to suit individual requirements, and these are more particularly described, infra. The kayak configuration may be sold with all the components as a complete package, or the kayak may be sold with only a few components for a specific market.

Typically, the kayak of this invention may be formed by blow molding, injection, roto molding, thermoforming, and possibly by forming by the more expensive resin or fiber glass lay-up techniques. A hollow shell can be produced by these techniques, thereby improving buoyancy. Suitable plastic resins of construction include polyethylene, PVC, ABS, polypropylene, polyester, and impregnated fibers such as fiberglass.

The bottom surface of the kayak of this invention defines a predominantly flat bottom having multiple channels to better provide tracking when paddling compared to most kayaks having a rounded bottom. Moreover, the flat bottom configuration of the kayak affords greater stability. During portability and during carrying by a single person it rests close to a user's body. This ease of portability is facilitated using a molded handle or by use of commercially available strap harnesses.

Drain holes molded through the body of the kayak enable the evacuation of any water that splashes inside the kayak during operation, thereby preventing water from collecting inside the kayak. Typically, these drain holes are situated inside the seat and cockpit areas and drain water away from the operator and towards the floor scupper drain holes. A drain hole may also be provided in a rear storage area for removing water and melted ice water when used as a cooler.

An important component of the kayak is a removable back rest that is ergonomically designed to support a significant portion of a user's back and is formed into a smooth curvature of the seat area. The back rest is easily removed and locks securely in place when being used. Present day kayaks incorporate a low profile, molded-in back rest that does not provide adequate support. This type of back rest is desired by manufacturers to accommodate better shipping rates due to size constraints. By contrast, when kayaks of this invention are shipped, the backrest is removable and stored in a bag at the front of the kayak, thereby enabling shipping economy.

Additionally, with the back rest removed, the kayak is stackable, and easy to package in a low profile box and easy to store leaning against each other in an upright configuration against any vertical surface. Hence, in addition to being better suited for shipping, the present configuration is useful for display in showrooms. Also, when the back rest is removed, a user will be enabled to more easily strap on additional gear.

Two back pack catches are provided at the boat end. Securing tie-down clips will secure items placed in the storage area when the back pack is not used as a cover. The hollow, double-wall configuration of the storage area provides good air insulation and for the storage area below the back pack unit to be used as a cooler with ice.

An overall length of about 7 to about 9 feet enables the kayak to be stored inside most mini vans or SUVS for security purposes and inside the storage compartments under many large motor homes or trailers; this also applies to stacking of two kayaks in RV enclosures. Many oversize kayaks require them to be carried and stored on top of an SUV, but this storage mode presents a potential theft problem. For indoor storage and display purposes an overall length of 7-9 feet is suitable.

Operationally, when the back rest is removed, a seated kayaker can perform kayak surfing maneuvers by leaning and balancing the kayak in any diagonal, sideways or rearward direction for more positive control and balance while surfing.

Structurally, a central, integrally formed, substantially raised reinforcing ridge is defined along a significant length of the kayak, and extends forwardly from the seat to the front area. Integrally formed foot rests are defined forwardly of the kayak and extend along both upper side walls to the bottom of the kayak; the foot rests reinforce the sides and bottom of the kayak. Bore holes may be formed in the reinforcing ridge to secure positioning of components for different kayak activities. These activities include sailing, a fishing pole holder, a flag indicator to signal scuba activity is occurring, rather than a boat adrift, a water bottle holder, recessed trays for temporary placement of personnel items, etc.

The bottom of the kayak is essentially flat and defines a plurality of longitudinal channels, coextensive with the boat length, thereby effecting stable, streamlined and controlled movement of the kayak. Two outer channels enable water movement therealong for improved kayak control. Also, the configuration of the kayak provides a keel defining a dropped down or lowered nose at the front keel section leading to the outer channels that provides additional directional stability when paddling.

A central, deeper channel is also defined and functions both as a structural reinforcement, and also to provide additional water channeling movement to improve directional stability and movement control. Dimensionally, the central channel and outer channels are about 1¾" to about 3½" wide, and typically about 2¾" wide. The depth of the central channel varies from about 1½" to about 2½". Some prior art kayaks have a fixed, high back rest to form a structure having a corresponding transverse channel in the kayak bottom; this enables stacking. However, use of a transverse channel would interrupt a streamline water flow along a central channel, making a kayak more difficult to control.

The rear portion of the boat may be used to attach a rudder to horizontal fins with through holes to also allow attachment of an additional rope carrying handle, or the rear portion may be utilized as the mounting platform for an electric motorized kayak propulsion unit.

DESCRIPTION OF THE PREFERRED EMBODIMENTS

Figure 1:
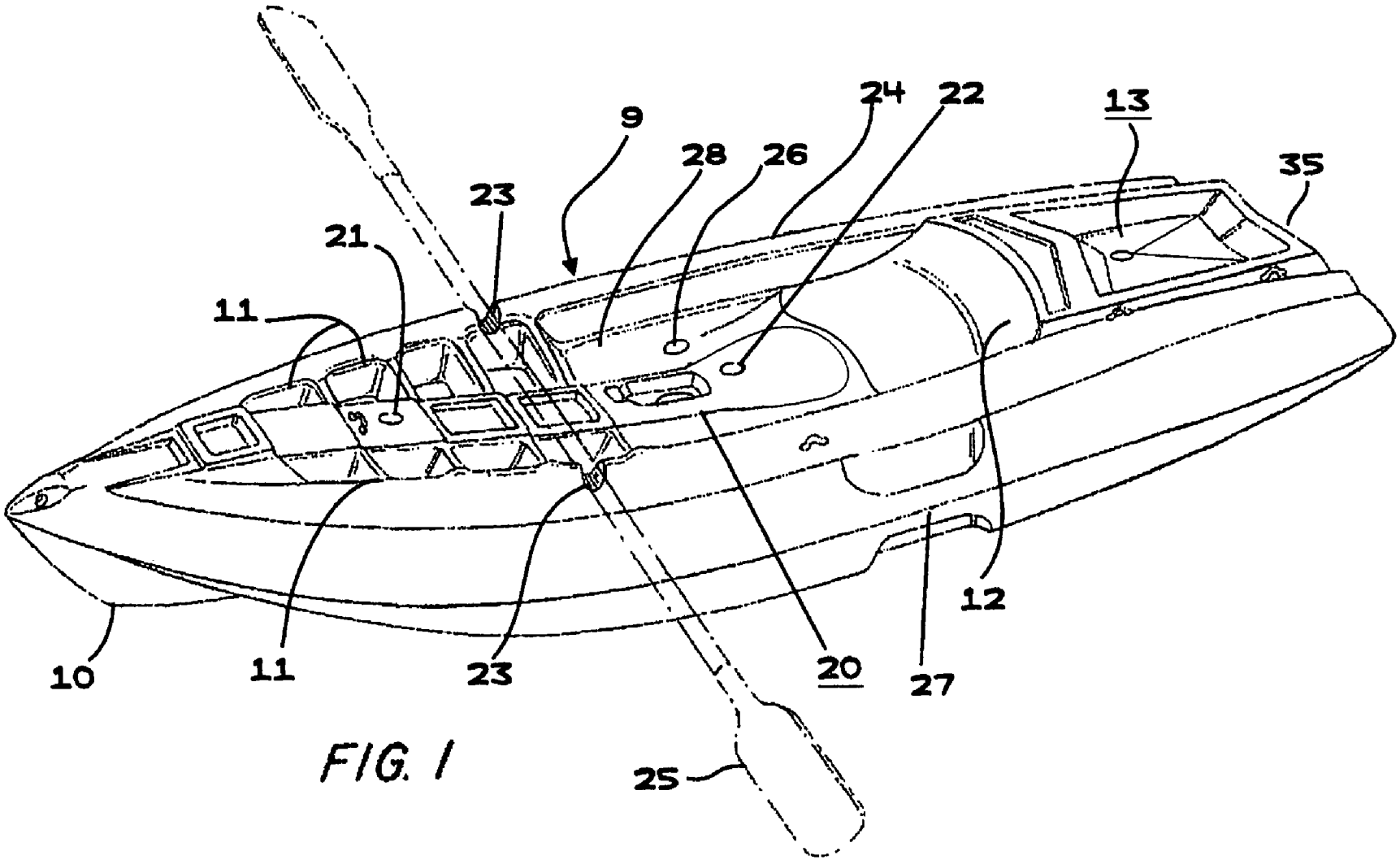
FIG. 1 is a perspective view of a kayak of this invention showing various component attachment points which may be included in the modular design.
Figure 10:
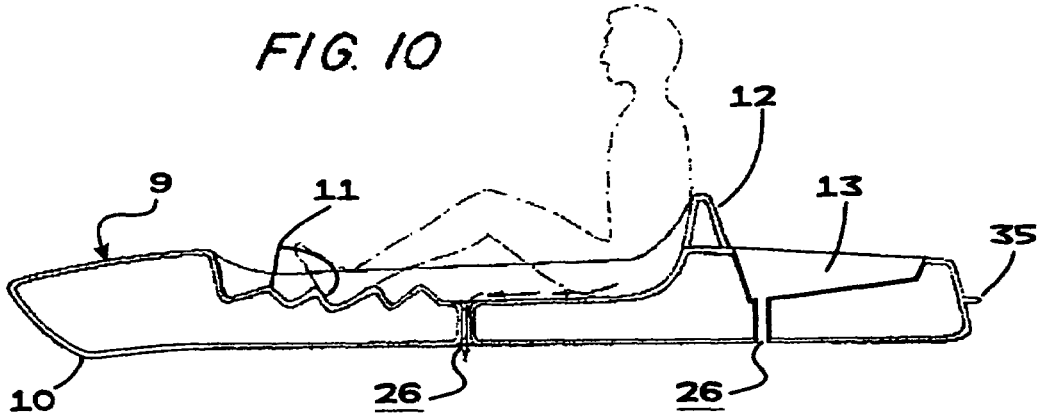
FIG. 10 is a view in sectional side elevation showing the kayak of this invention with a kayaker seated inside.

FIG. 1 shows a sit-on-top kayak 9 of this invention defining a front end 10 of the keel which is dropped down somewhat leading to an underside of the kayak, for better directing water flow. Integrally formed reinforcing recesses 11 on either side of the kayak sidewalls accommodate different leg lengths of a user. As shown in FIG. 10, an integrally formed seat and back rest 12 are provided for a user, and as shown in FIG. 2, the back support forms a lock-in, or other hand-removable fit to enable removal and replacement.

Figure 2:
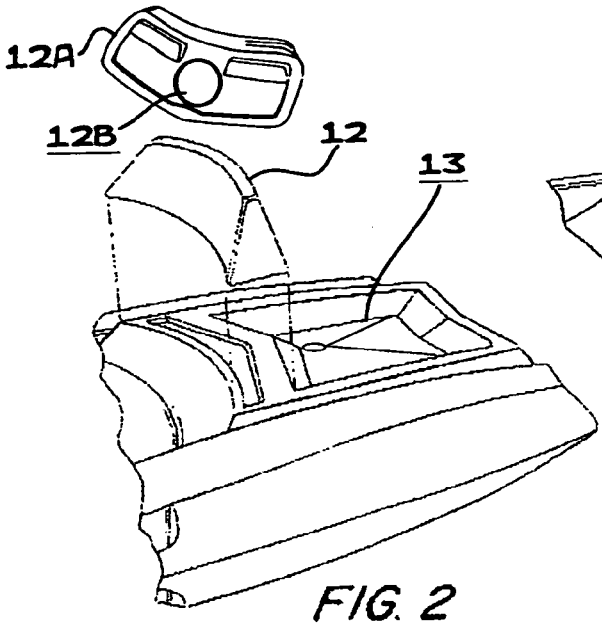
FIG. 2 is a perspective view of the removable back rest and porthole with a cover.
Figure 5:
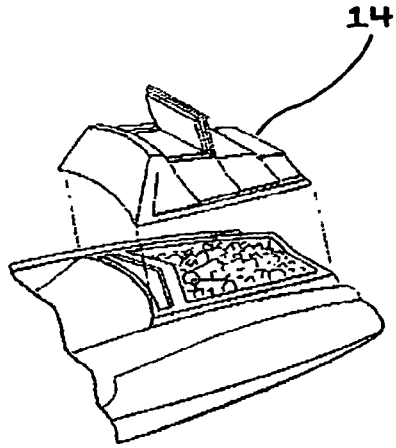

As shown in FIGS. 1 and 2, a storage space 13 is shown behind and adjacent of the back rest 12, and rearwardly of the kayak. FIG. 12*a* shows the underside of the back rest 12, and FIG. 12*b* shows a hole for use to insert various personal and food items into the hollow back rest. A protective cover 14 enclosing the storage space is shown in FIG. 5. The storage space protects items such as food, clothes, gear, etc., against water and sun and also secures items from being lost due to wave action. The storage space has a double wall construction to provide better insulation for food, and to maintain ice cooling.

Figure 4:
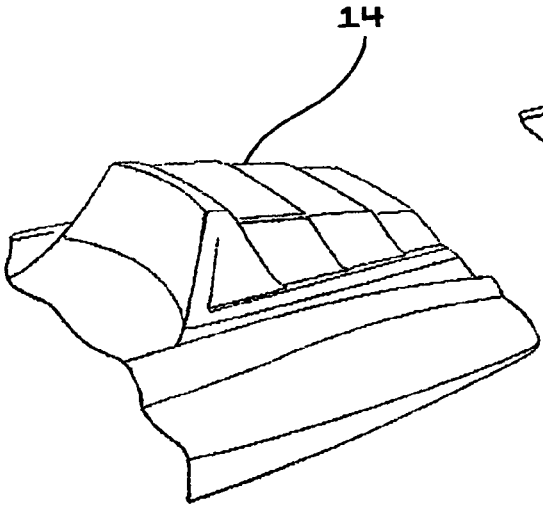
Figure 6:
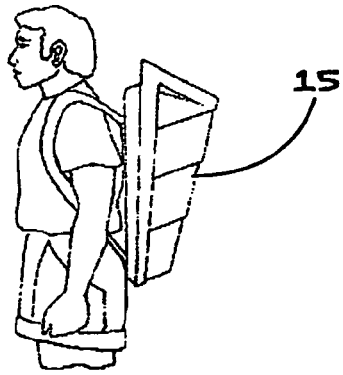
FIG. 6 is a perspective view of a user with a back pack incorporating the removable storage space of FIGS. 3, 4 and, 5.

If desired, the seat and storage space 13 may be made removable, as shown in FIGS. 4 and 5 so that they may be carried as a back pack 15 unit, as shown in FIG. 6. This enables a user to carry a portion of the overall kayak load and enables separate transportation of the kayak.

As shown in FIG. 1, a longitudinal, central reinforcing ridge 20 is defined from the base of the seat 12 to the front of the kayak, and centrally of the recesses 11. A molded securing bore hole 21, shown in FIGS. 1 and 5, is formed forwardly of the reinforcing ridge for receiving a sail support or a sail, and a securing bore hole 22 is formed to receive a fishing pole holder.

Recesses 23 are defined along the upper sides 24 of the kayak and function to provide seating for possible use of oars 25 shown in dotted designation. An integrally formed carrying handle 27 may be used for purposes of transporting the kayak.

Figure 8:
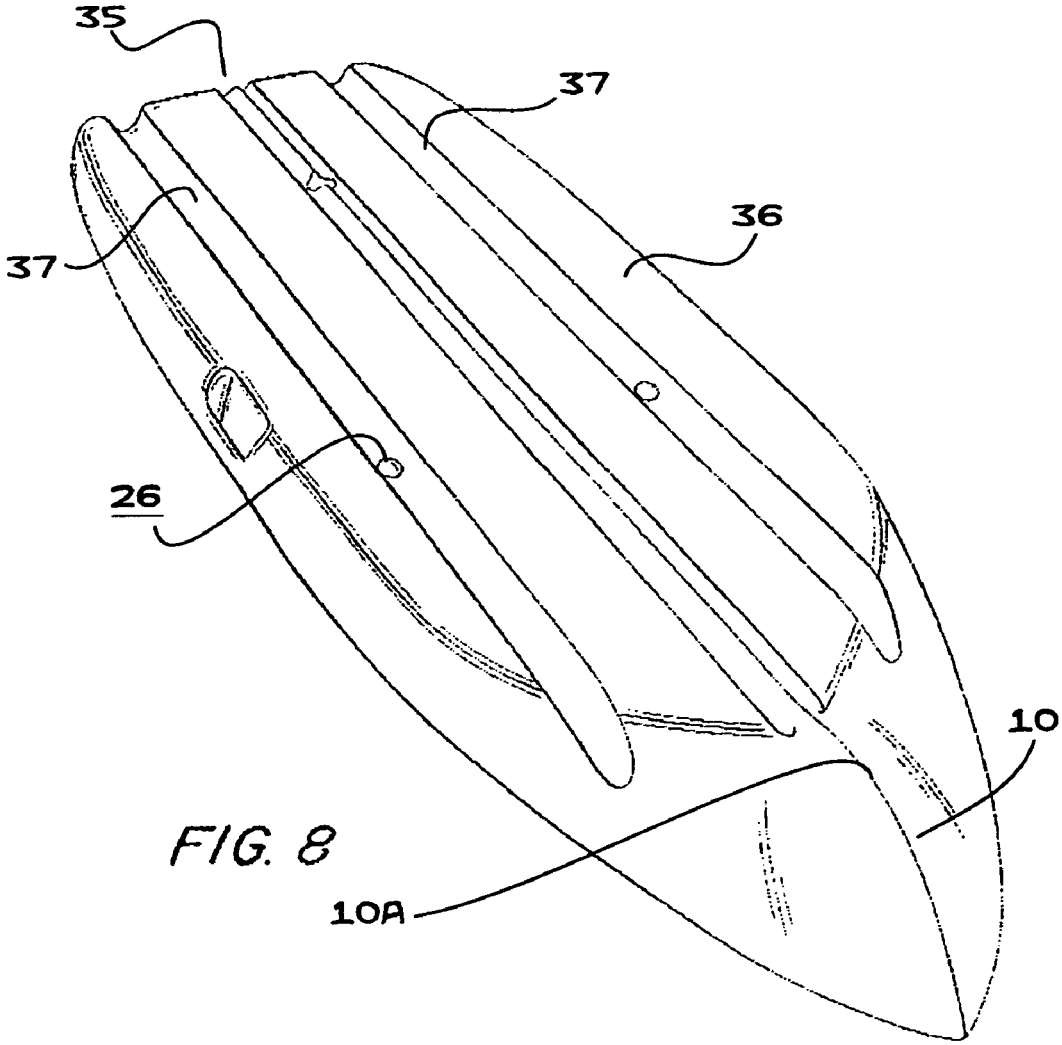
FIG. 8 is a perspective view of the kayak bottom; and, FIG. 9 is an upper perspective view of the kayak showing its use in conjunction with a sail.

Molded drainage bores 26, some of which are shown in FIGS. 1, 8 and 10 function to drain water away from the kayak operator and towards the transom and rear scupper holes. If desired, where ice is utilized in the storage space 13, additional drain bore 26 may be located in the storage space to drain water when the ice melts. Drain channels 28 defined along each side of the kayak side walls collect water spray and wave splashing for drainage into the drain bore holes.

Figure 12:
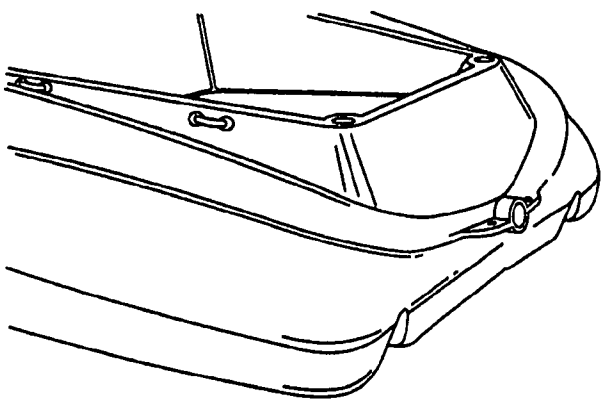
Figure 11:
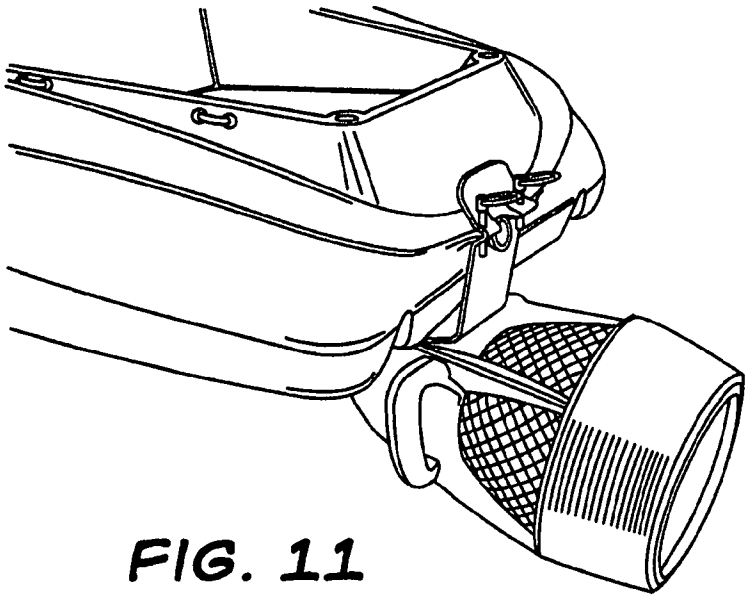
FIG. 11 is an external view in side elevation showing the kayak and an electric motorized power unit attachment which may also incorporate a tiller steering control; and, FIG. 12 is an external view, partially in perspective showing dual attachment fins for the power unit.

The rear 35 of the kayak may be utilized to provide integrally formed, dual horizontal fins to allow attachment of an additional rope carry handle, rudder, or the kayak rear may be used as the mounting platform for an electric or other type of motorized kayak propulsion unit. These embodiments are shown in FIGS. 11 and 12.

The double wall thickness of the storage space 13 also functions to impart sufficient tensile strength to the kayak rear 35, so that use of a propulsion unit is facilitated without compromising the structural integrity of the kayak.

As shown in FIG. 8 the bottom 36 of the kayak defines outer water flow channels 37 and a central, reinforcing and deeper water flow channel 38, the three channels extending the length of the underside. Use of these channels provides a streamlined water flow movement along the kayak bottom 36 and enables for better control and maneuvering of the craft. Also, since the keel front end 10 is lowered somewhat to define a drop-down keel 10*a*, this configuration tends to direct water flow to channels 37 and 38, and results in a more efficient streamlining effect.

Figure 9:
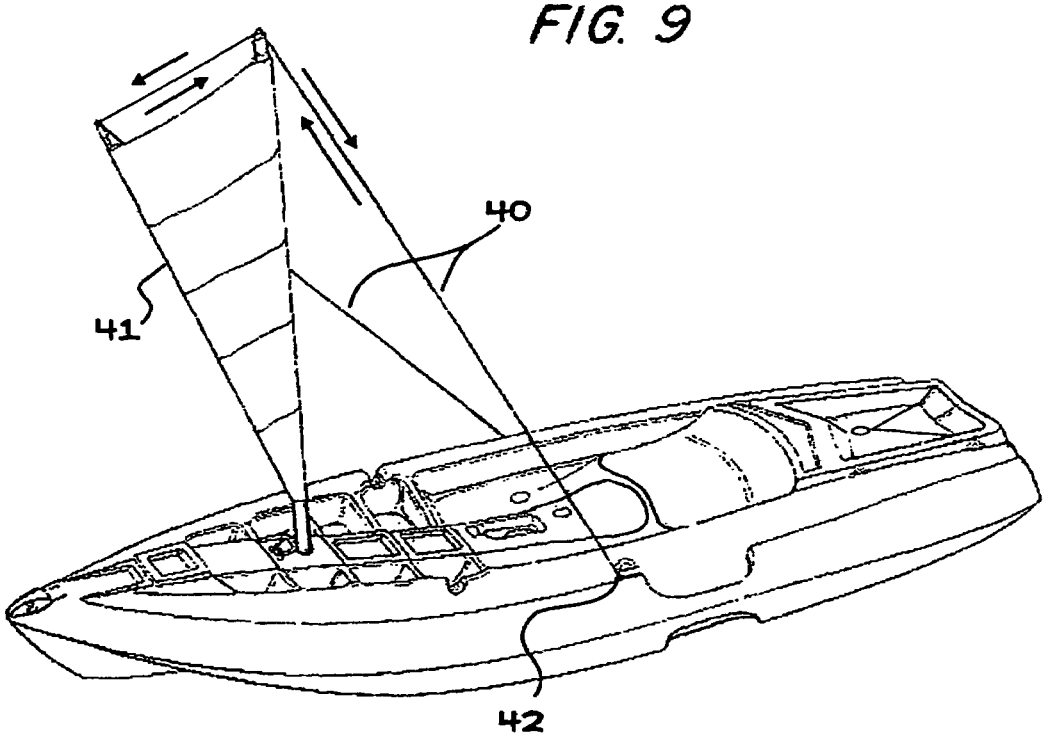

In FIG. 9, when the kayak of this invention is used for sailing, a rope 40 is provided to control a sail 41. The left hand side of the control rope at the mast include a single knot. This will fix the left hand length of the rope. The right hand side of the rope is slidably connected to the upper portion of the mast. Hence, retraction or release of the right hand side of the rope will either retract or expose the sail to the wind and accordingly effect speed control. Swivelling the sail across its mast anchor points controls the direction of wind exposure.

Figure 7:
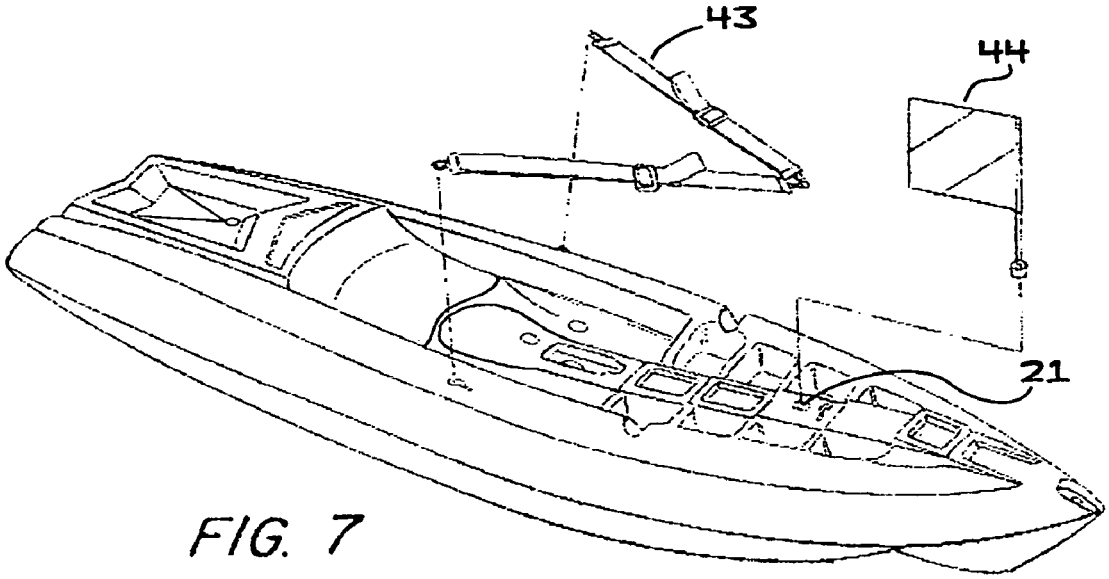
FIG. 7 is a perspective view showing use of the thigh strap attachments for kayak surfing.

The control rope 40 is attached to the kayak at the user's side by reinforced connections 42. As illustrated in FIG. 7, thigh straps 43 are shown which may be used in conjunction with the mast anchor connection 42 for additional sail control.

Figure 3:
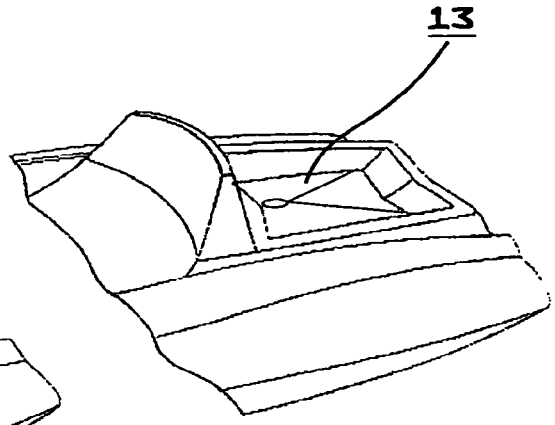
FIGS. 3, 4 and 5 are perspective views illustrating a removable storage space which may be carried by a user to split the weight of a back pack and kayak during transportation.

FIG. 7 also illustrates use of the kayak during scuba diving activities, sea activities such as underwater fishing, sea bed viewing, and the like. In this case the molded receiving bore hole 21 shown in FIG. 1 is designed to receive a signal or warning flag 44 to indicate the boat is being used by a scuba diver to return, rather than being considered as a boat adrift. In addition, the flag 44 warns motor boaters that scuba divers are in the immediate vicinity. As shown in FIG. 3, the back rest 12 is removed to allow the scuba diver enough room to put on or take off his gear while still being seated.

FIG. 7 additionally illustrates use of the kayak in conjunction with the thigh straps 43 which may be used by a surfer for securement to the kayak during kayak surfing. In this embodiment the backrest 12 is removed to enable full movement along the kayak by the kayaker for kayak surfing, and the warning flag 44 is removed.

The sit-on-top kayak of this invention provides a multipurpose use by utilizing a removable back rest, a streamline bottom portion, and a reinforcing ridge along a substantial length of the kayak. The removable back rest facilitates kayak surfing; attachment and removal of driving gear; carrying; transportation; and stacking for storage purposes. The continuous, streamline flat bottom and water channels facilitate stability and improved control and manoeuvering of the kayak for kayak surfing, sailing and paddling. The reinforcing ridge strengthens the kayak and provides one or more molded securing bore holes for attachment of sailing equipment and for positioning of a warning flag to indicate the presence of scuba divers.

The invention claimed is:

1. A plastic formed, sit-on-top kayak defining a flat, continuous bottom surface, a downwardly sloping front end which together with two outer grooves and a centrally V-shaped reinforcing groove for directing water flow along the bottom surface, thereby improve directional stability and control, and a raised, reinforcing ridge disposed centrally along the kayak and extending forwardly from a rear support seat and extending near the front end of the kayak, the reinforcing ridge together with the V-shaped reinforcing groove thereby improving structural integrity, the sit-on-top kayak defining a double-wall storage space positioned rearward of the kayak, and a partially squared-off tail end behind the storage space forming a mounting platform for attachment thereto of items including a propulsion unit and a rudder and surfing fin, the storage space and squared-off tail providing a stable base having sufficient tensile strength to impart structural integrity to the kayak during use of these items, the reinforcing ridge defining at least one bore hole for securing items, including one or more of a sail, flag indicator, a water bottle holder, recessed trays and a fishing pole.

2. The sit-on-top kayak of claim 1, which provides a removable back rest and removable storage space to enable a user to carry a portion of a kayak load, thereby enabling separate transportation of the kayak.

3. The sit-on-top kayak of claim 1, providing a removable, integrally molded back pack and back pack with attachment straps for carrying purposes.

4. The sit-on-top kayak of claim 3, including an integrally molded, removable back rest and storage unit for carrying purposes.

5. The sit-on-top kayak of claim 1, defining U-shaped outer grooves and a V-shaped reinforcing central groove.

6. The sit-on-top kayak of claim 1, including a partially squared-off tail end of the kayak, that increases flotation for a given length, and provides a stable base for standing the kayak up against a flat vertical surface enabling efficient storage and transportation.

7. The sit-on-top kayak of claim 1, in which the back rest is hand removable.

8. The sit-on-top kayak of claim 1, defining two outer grooves and a central, continuous reinforcing groove along the bottom surface.

9. The sit-on-top kayak of claim 1, in which reinforcing foot rests are defined on both sides of the reinforcing ridge.

10. The sit-on-top kayak of claim 1, providing a sail structure including control ropes slidably connected to an upper mast portion of the sail, at their lower end, the control ropes being connected to the kayak adjacent the operator, whereby slidable retraction or loosening of the control ropes will reduce or increase wind exposure of the sail, thereby effecting speed control and tracking direction by the operator.

* * * * *